US007131846B2

(12) United States Patent
Barlerin et al.

(10) Patent No.: US 7,131,846 B2
(45) Date of Patent: Nov. 7, 2006

(54) INTEGRATED UNIT WITH ANTENNA AND SWITCH

(75) Inventors: Stephane Barlerin, Fatines (FR); Antoine Fares-Karam, Le Mans (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/484,596

(22) PCT Filed: Jul. 25, 2002

(86) PCT No.: PCT/EP02/08273

§ 371 (c)(1),
(2), (4) Date: Oct. 27, 2004

(87) PCT Pub. No.: WO03/012933

PCT Pub. Date: Feb. 13, 2003

(65) Prior Publication Data

US 2005/0048823 A1 Mar. 3, 2005

(30) Foreign Application Priority Data

Jul. 27, 2001 (FR) ..... 01 10156

(51) Int. Cl.
*H01R 12/00* (2006.01)

(52) U.S. Cl. ..... 439/63; 439/931; 439/944; 439/916

(58) Field of Classification Search ..... 439/188, 439/916, 944, 581, 63, 931; 343/702
See application file for complete search history.

(56) References Cited

U.S. PATENT DOCUMENTS

| | | | | |
|---|---|---|---|---|
| 5,668,559 | A * | 9/1997 | Baro | 343/702 |
| 6,171,123 | B1 | 1/2001 | Chang | 439/188 |
| 6,336,820 | B1 | 1/2002 | Hida | 439/188 |
| 6,473,045 | B1 | 10/2002 | Duquerroy et al. | 343/702 |
| 6,980,157 | B1 * | 12/2005 | Nevermann | 343/702 |

FOREIGN PATENT DOCUMENTS

| | | |
|---|---|---|
| EP | 0601702 A1 | 6/1994 |
| WO | WO 00/33425 | 6/2000 |

* cited by examiner

*Primary Examiner*—Phuong Dinh
(74) *Attorney, Agent, or Firm*—Perman & Green, LLP

(57) ABSTRACT

Integrated unit (1) having a connector (3) mounted on a printed circuit (2), the connector having a support (4) in which are placed a first blade (5) and a second blade (10) linked to the printed circuit, the first blade having on an upper side (8) of the support, an extension (7) forming an antenna (6). This first blade is preferably formed by the metallisation of the plastic support. The second blade comes into contact with the first blade. The support has a cavity (18) to receive a coaxial plug (25) and thus to switch the connection between the first and second blades, for a new connection between this second blade and the coaxial plug.

12 Claims, 2 Drawing Sheets

INTEGRATED UNIT WITH ANTENNA AND SWITCH

This application claims the benefit of the earlier filed International Application No. PCT/EP02/08273, International Filing Date, Jul. 25, 2002, which designated the United States of America, and which international application was published under PCT Article 21 (2) as WO Publication No. WO 03/012933 A1.

An object of the present invention is an integrated unit with antenna and switch. It can be used more particularly in the field of coaxial connectors for antennas, especially those placed inside cell phones. A cell phone generally comprises a printed circuit linked to a first antenna to emit and receive radio-frequency signals. This first antenna is usually an integrated part of the cell phone, it can be internal. Such a telephone can also include a coaxial connector to commute the origin of an emitted and/or received signal from this first antenna for a signal coming from a second antenna, usually external. The advantage of this invention is to offer an integrated unit including both an antenna and a switchable coaxial connector. Another advantage of the invention is to propose a simple procedure to obtain such an integrated unit.

In the prior art, some cell phones have an internal antenna and a switchable coaxial connector. This switchable connector is generally placed between the internal phone antenna and a signal processing system placed on the phone's printed circuit board, to which the antenna is connected. This connector notably allows to receive an external coaxial plug to be connected to a second antenna. In this case, the connector has to switch between the signal emitted and/or received via the first antenna for the signal emitted and/or received by means of this second antenna.

To this end, the connector usually has a mechanical device to switch the contact made inside the connector. In fact, a first contact linked to the first antenna is, first of all, connected to a second contact, this second contact being connected to the signal processing system. In a second step, in which the second antenna is inserted into the connector, this first contact is then disconnected from the second contact by a movement of this second contact. In fact, during insertion of the coaxial plug into the connector, the plug comes into contact with part of the second contact in such a way that the second contact is pushed away and separated from the first contact.

It is also known from the prior art, from the teaching of document WO-A-00/33425, that there is a connector specifically mounted with means of commutation specially designed to switch antennas. This connector is mounted on a printed circuit. It mainly includes two metal blades erected perpendicularly to this printed circuit. The first metal blade is connected to the internal antenna of a phone in which this printed circuit is placed. In other respects, the second connector blade is slightly flexible with regard to an axis perpendicular to a plane formed by the printed circuit from which it protrudes. The second blade is notably curved in the direction of the first blade, it is mounted opposite the first blade. This curve is moreover equipped with a lateral arm allowing to come into contact with this first blade. In fact, the second blade is pre-stressed in such a way that in the absence of additional stress, in an inactive state, it comes into contact with the first blade.

Free ends of both blades are located in a support cavity of the connector, inside which they are mounted. This cavity is also designed to receive a male pin of a coaxial plug. When this coaxial plug is fitted onto the switchable connector, the male pin is inserted into the cavity, and more particularly, between the two blades of the connector. To be more exact, this male pin comes into contact with the second blade. The presence of the male pin pushes a flexible blade of this second blade backwards. Thus, the male pin is henceforth connected to the second blade, the latter being forced against it. Consequently, the coaxial plug is connected to the signal processing device. Furthermore, in pushing back this second blade, this disconnects it from the first blade and therefore the first antenna is no longer connected to the signal processing device. Therefore, commutation has occurred.

The internal antenna of the cell phone is usually in the form of a radio-electric radiant element. More particularly, this element can be a metallisation formed on the printed circuit or on another component placed inside the phone case. This metallisation generally has special geometric and environmental characteristics to guarantee the quality of emission and reception. On the other hand, this internal antenna is still connected via a link to the printed circuit where the radio frequency signals are processed. This link is electric and calibrated. In fact, when the telephone emits, the signals transmitted by the antenna are high frequency or even hyper frequency. Signals with these characteristics should be transmitted by metallic links having very specific forms and characteristics. These links will not tolerate great variability during construction.

Known switchable cell phones raise a problem. In fact, due to the presence of a switchable connector between the internal telephone antenna and the signal processing device, it is necessary to extend the length of the link between this antenna and the signal processing device in order to place the switching connector on the printed circuit. But, this link must be made with great precision and tolerates practically no variation during its construction. The presence of such a difficult link to establish on the printed circuit poses a cost problem and generates manufacturing rejects.

In other respects, the manufacture of such telephones involves a multitude of steps, various elements being prepared separately and assembled with one another step by step. In fact, the internal antenna, the coaxial connector, the printed circuit are prepared independently using different techniques, and assembled afterwards.

The invention is intended to solve the problem by proposing a telephone in which the switchable connector comprises the internal antenna itself. There is therefore no link to be made between this switchable connector and the internal antenna. Thus the length of this link is minimal. In fact, according to the invention, the connector has two blades which can be selectively put into contact with each other, but is such, that one of the blades has a conductive surface on one side of a support, on which this conductive surface is drawn, so that it possesses the technical characteristics of radio-frequency antennas.

In other respects, a manufacturing procedure for such an integrated unit, including a switchable coaxial connector, this connector itself having an antenna on one of its blades, is simple. In fact, after having moulded a plastic support, this support is surface metalled so that the first blade, with the antenna, is formed by metallisation. A second blade to this coaxial connection is prepared separately and inserted, after metallisation of the plastic, into a cavity of the support. This second blade is flexible and can selectively come into contact with the first blade.

The subject of the invention is a unit having a printed circuit, an insulating support, a first antenna, a switchable coaxial connector, the connector having at least a first contact blade and a second contact blade allowing to switch a signal origin, received by the printed circuit, between a signal received by the first antenna or a signal received from a coaxial plug, the first blade having an extension placed on the support so as to form a first antenna.

The invention will be understood more clearly from the following description and the appended figures. These figures are given purely by way of an indication and in no way restrict the scope of the invention. Of these figures.

Figure 1:
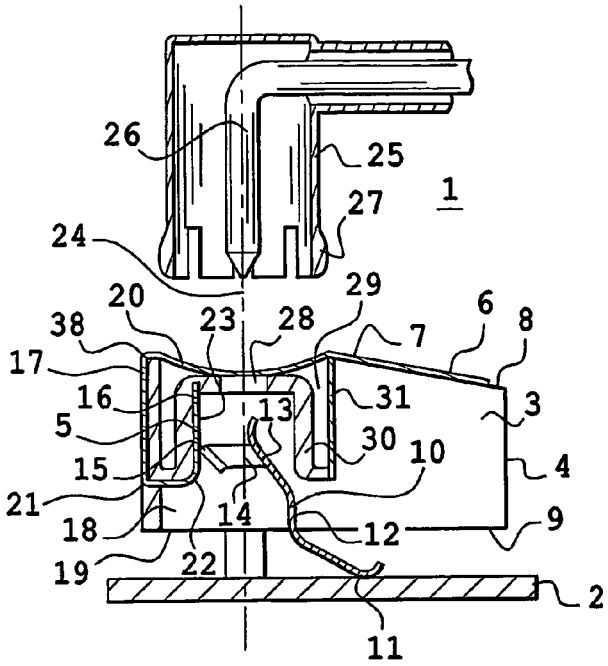
FIG. 1 shows a side view of a first manufacture of an integrated unit as per the invention before fitting the coaxial plug.

FIG. 1 shows a unit 1 according to the invention. This unit 1 has a printed circuit 2 and a connector 3. The connector 3 comprises an insulating support 4 and at least a first contact blade 5.

The printed circuit 2 is preferably placed inside the cell phone. It has, for example, a radio-frequency type signal processing device. To that end, it is connected via the first blade 5 to an antenna 6. This antenna is an internal antenna.

The antenna 6 is formed in continuity with the first blade 5, the first blade 5 extending the antenna, and preferably corresponds to an internal antenna of a cell phone inside which the connector 3 is mounted. The support 4 is made out of plastic. Preferable, the antenna 6 is obtained by direct plastic metallisation, selective polymer metallisation, or according to a technology used to make tridimensional moulded circuits, commonly known as MID, according to the internationally used abbreviation. In the prior art, plastic metallisation are known from documents U.S. Pat. No. 4,882,200 and EP-A-0 834 598 and more generally known from document GB-A-1,254,308. Preferably, the support 4 is made in such a way that it possesses a print or a partially modified surface to capture the metallisation. This metallisation later forms both the internal antenna and the first blade.

The first contact 5 is placed round and through the support 4. The antenna 6 is formed in an extension 7 of this first contact 5. This extension 7 corresponds to part of the contact 5 placed on an upper side 8 of the support 4. The support 4 has basically a parallelepiped shape, with a lower side 9 placed opposite the printed circuit 2, in such a way that this lower side 9 of the support is opposite the upper side 8. The contact 5 has a segment or arm connecting the upper side 8 to the lower side 9 as well as a segment of the lower side of the support.

The antenna 6 is linked to the printed circuit 2 via a second contact 10 of the connector 3. This second contact 10 is preferably a flexible blade. This flexible blade therefore includes a first flexible portion 11, corresponding to an infeed segment protruding from the lower side 9 to come into contact with a conductive track (not shown) of the circuit 2. According to FIG. 1, the first infeed segment 11 is a flexible portion having a contact end piece. In fact, the contact end piece is, for example a clip bent over to be soldered onto the circuit surface 2. This first flexible portion 11 is connected to a middle portion 12 of the second contact 10. This middle portion 12 is maintained in the support 4. Inside the support 4 the second contact 10 has a second flexible portion to come into contact with the first blade 5. The second contact 10 is inserted from the lower side 9 into the support 4.

According to a first embodiment, the second flexible portion 13 has an arm 14 to come into contact with the blade 5. In fact, the arm 14 is positioned at right angles to the middle portion 12 and allows to limit the bend of the second flexible part 13 in respect to this middle portion 12. The arm 14 comes into contact with the blade 5 at a single point 15. Thus, the first blade 5 is connected to the printed circuit 2 via the second contact 10. The point 15 is preferably located on an arm 16 of the blade 5.

The first blade 5 has therefore, in addition to the extension 7 located on the upper side 8 of the support 4, the arm 16 which follows an outside perimeter 17 of this support 4. The arm 16 curves back inside a cavity 18 of the support 4. The cavity 18 includes a first opening 19 on the lower side 9 and a second opening 20 on the upper side 8. The arm 16 folds up inside this cavity 18 at the opening 19 and thus forms two elbows, respectively 21 and 22 to present a portion 23 of the arm 16 which is positioned parallel to an axis 24 connecting the first opening 19 to the second opening 20.

The second flexible portion 13 of the second contact 10 is also put into this cavity 18. The second flexible portion 13 crosses this cavity 18 to come into contact with the first blade 5 at the contact point 15. Preferably, neither this second flexible portion 13, nor the arm 14 should cut across this virtual axis 24. The arm 14 is curved, with a curve centre on this axis 24. In fact, the cavity 18 represents a reception chimney to receive a coaxial plug 25. This coaxial plug 25 has preferably a male pin 26, placed inside a hollow casing 27 from which it is insulated. Preferably, when the coaxial plug 25 is introduced into the cavity 18, the male pin 26 is inserted from the second opening 20 in this cavity 18, parallel to the axis 24.

The second opening 20 has a special shape. In fact, in order to receive the coaxial plug, this second opening 20 has a first aperture 28 of such dimensions that it can only receive the male pin 26, and a second aperture 29 to receive the edges of the casing 27. This second aperture 29 is toroidal, it is formed between an external perimeter of walls 30 placed round the first aperture 28 and an internal perimeter 31 of the cavity 18 at the second opening 20. This second aperture 29 opens out onto a ring-shaped cavity. The walls 30 and the perimeter 31 are preferably parallel to the axis 24, and therefore at right angles to the printed circuit 2.

The casing 27 has a hollow form, inside which, preferably at the symmetrical rotation axis of this hollow form, the male pin 26 is placed. Thus, when the male pin 26 is inserted into the first aperture 28, simultaneously the casing 27 is placed inside the second toroidal aperture 29. When the male pin 26 is introduced into the second aperture 28 following the axis 24, it comes into contact with the second flexible portion 13. Then it pushes back the second flexible portion 13 in the direction of an internal perimeter of the walls 30. Ideally, the middle portion 12 is retained at this internal perimeter. It thus connects the arm 14 to the first blade 5. The arm 14, which forms preferably a curve, then comes into contact with an external perimeter of the male pin 26 enveloping it over at least part of its circumference. The external diameter of the male pin 26 is of a dimension such as to allow to push back the second blade 10 without however coming into contact with the first blade 5.

Complete insertion of the coaxial plug 25 results in the connection of the male pin 26 to the arm 14, that is to say with the second contact 10 and therefore the printed circuit 2. In an prefered manufacturing method, the coaxial plug 25 is linked to an external antenna for cell phones. For example it corresponds to the plug connected to an external antenna in a "hands free" kit, placed for example inside a car.

Figure 2:
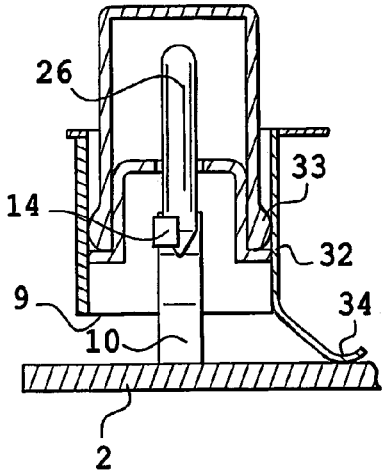
FIG. 2 shows a side view at 90° to FIG. 1, representing a integrated unit as per the invention connected with coaxial plug.

FIG. 2, the connector 3 has an earth blade 32. For all models, the antenna 6 is a radiant element having at least one high reception zone of signals and one zero reception zone of signals. This zero reception zone for signals corresponds to the zone of the antenna 6 where the ring-shaped cavity 29 opens. Thus, in the ring-shaped cavity 29 the antenna 6 is connected to earth via the earth blade 32. This earth blade 32 has a part placed inside the space between the wall 30 and the perimeter 31. When inserting the casing 27 in this place, the casing 27 also enters into contact with the earth blade 32. More particularly, the casing 27 has several external lateral bumps 33 which come to force against this earth blade 32.

In a variant, the lateral bumps are directed in a radial way, but towards the inside of the casing 27. In this variant, they come to force against the earth blade 32 which is in this case is placed on the walls 30. The earth blade 32 has a flexible portion 34 intended to be connected and forced on the printed circuit 2, the connector 3 being preferably mounted on the surface of the circuit 2. For example, the earth blade 32 of the flexible portion 34 is made in the same way as the flexible portion 11 of the second blade 10. In a first method of manufacturing, shown in FIG. 2, the second blade 10 and the earth blade 32 are shown opposite each other at an 90° angle.

Figure 3:
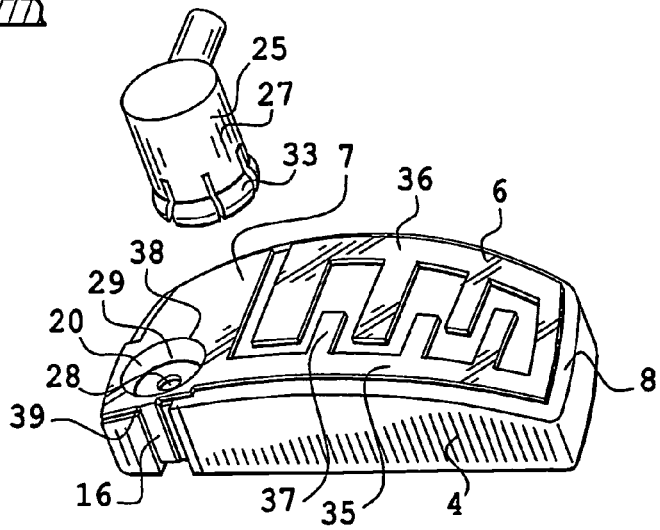
FIG. 3 shows a top view of the integrated unit as per the invention, before fitting of the coaxial plug.

FIG. 3, a special shaped metallisation forms this antenna 6. In this example, the antenna 6 is obtained by making a crenellated linear pattern. In fact, metallisation of the upper side 8, forms a band bordering this upper side 8 having at least two portions 35 and 36 opposite each other. From each of these portions 35 and 36, teeth 37 stretch out parallel to the plane in which the metallisation is formed. The teeth 37 stretch towards a space situated between the portions 35 and 36. The teeth 37 of the first portion 35 are moreover placed in such a way as to be staggered with the teeth 37 of the second portion 36. The teeth 37 are interdigitally placed. The metallisation has then the form of a rake folded in two. In other respects, width and length of each of these teeth 37 are variable and increase slightly from the first portion 35 to the second portion 36, the first portion 35 being placed near to the second opening 20.

Preferably, the opening 20 of the upper side 8 opens into the extension 7. Thus, when making the extension 7, the arm 16 and thus the whole of the first contact 5 can be made in one go at the same time. Where the first contact 5 is made by direct metallisation on the plastic of the support 4, a device is provided to simultaneously metallise the various zones of the support 4, in order to make this first contact 5 in one layer.

In a variant, only the extension 7 is obtained by direct metallisation on the support 4, the arm 16 is then obtained by cutting a metal blade out of a sheet of metal. This blade is then soldered to the extension 7 at a point 39 to form an elbow with the upper surface 8.

The second contact 10 is preferably made by cutting a long blade out of a metal sheet. The first contact blade 5 can also be obtained by cutting out of a thin metal sheet.

Figure 4:
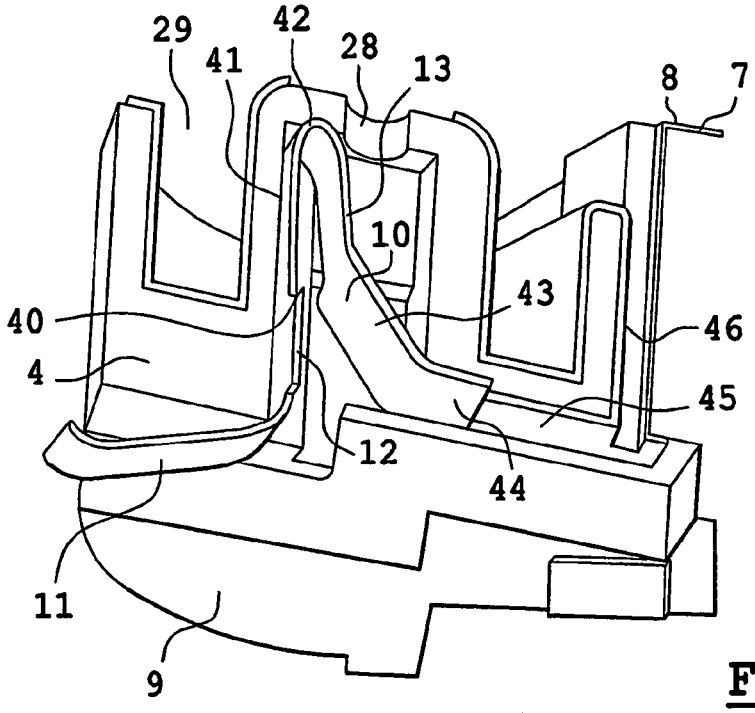
FIG. 4 shows a partly cut view of an integrated unit switch, following a second method of manufacturing the invention.
Figure 5:
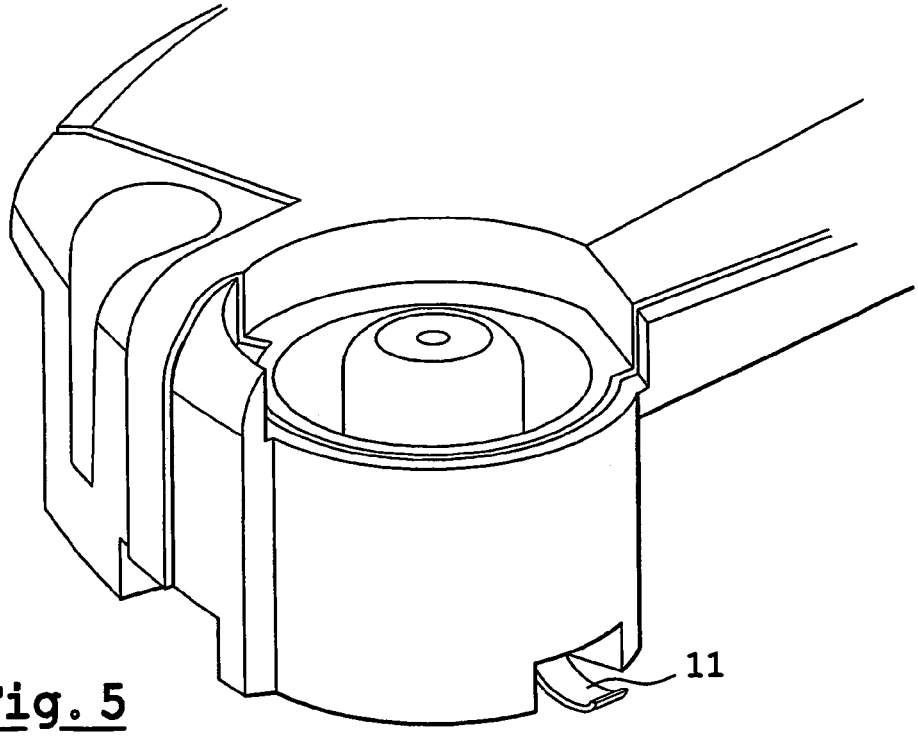
FIG. 5 shows a top view of an integrated unit switch, following the second method of manufacturing the invention.

In a variant, shown in FIG. 4, the middle portion 12 has anchor means 40 so as to be retained in the wall 30 of the cavity 18. This anchor means 40 can for example have side teeth 41 to correspond with a notch in the inside perimeter of the wall 30.

Following a second manufacturing method, the second flexible portion 13 has an elbow 42. This elbow 42 is a bent vertex placed at one end of the middle portion 12. The middle portion 12 is by this means linked to a spring segment 43 of the flexible portion 13 descending slantwise inside the cavity 18. This spring segment 43 passes through the cavity 18 and cuts the axis 24. Thus, when the coaxial plug 25 is inserted, the male pin 26 stops against a portion of this spring segment 43. The spring segment 43 has a end piece 44. In an inactive state, this end piece 44 is ideally directed perpendicularly to this axis 24. The end piece 44 comes in full lock against a zone 45 of the first blade 5 on the lower side 9. Just as for the zone situated between the elbows 21 and 22, according to the manufacturing method in FIG. 1, the zone 45 of manufacturing method according to FIG. 4, is a metallised zone connected by an arm, perpendicular to the lower and upper surfaces of the support 4, to the antenna 6. This arm can be made by a cross-piece 46 in this support, the zone 45 forming contact rupture being opposite a distal extremity of the second contact blade 10.

The end piece 44 is a switch, because, depending on the stresses exerted on the spring segment 43, this comes into contact, or not, with the zone 45. But the second contact is connected to the printed circuit 2. Therefore, the zone 45, together with the antenna 6 of the extension 7, can be selectively linked to the printed circuit 2. Notably, when inserting the male pin 26 in the cavity 18, this comes to push the spring segment 43 moving it from its inactive position. This movement of the spring segment 43 involves a movement of the end piece 44. This is moved to a position where it is no longer in contact with the zone 45. In fact, it is placed slantwise in respect to the axis 24. In this state, the antenna 6 is thus disconnected from the printed circuit 2, in view of the fact that the link between the end piece 44 and the zone 45 is interrupted. In the same state, the male pin 26 is connected to the printed circuit 2.

The blade, cut out to form the second contact 10, is then pre-stressed in such a way as to obtain the various portions 11, 12 and 13, and possibly the curved arm 14. In a variation, the first contact blade 5 can also be made by cutting it out of a thin metal sheet.

The invention claimed is:

1. Unit comprising a printed circuit, an insulating support, a first antenna, a switchable coaxial connector, the connector having at least one first contact blade and a second contact blade allowing to switch the origin of a signal received by the printed circuit between a signal received from the first antenna or a signal received from a coaxial plug, characterised in that the first blade and the first antenna placed on the support are formed in continuity by moulded interconnect device metallisation.

2. Unit according to claim 1 characterised in that the support has a cavity in which the coaxial plug can be introduced, and in that the second blade is inserted from the lower side.

3. Unit according to claim 1, characterised in such that the first antenna covers the upper side of the support.

4. Unit according to claim 1, characterised in that the second blade has a flexible portion crossing the cavity to come into contact with an arm or with a zone of the first blade.

5. Unit according to claim 1, characterised in that the second blade has at least one flexible portion to insure connection between the printed circuit and the first blade, in the absence of the coaxial plug.

6. Unit according to claim 5, characterised in that the flexible portion insures connection between the printed circuit and the coaxial plug, in the presence of the said coaxial plug.

7. Unit according to claim 1, characterised in that the first antenna has a crenellated linear pattern and has two portions opposite each other, the pattern being preferably of the folded rake type.

8. Unit according to claim 1, characterised in that the first antenna is an internal antenna of a cell phone, and that the coaxial plug is a plug for an external cell phone antenna.

9. Unit according to claim 1, characterised in that the connector has an earth blade placed on the circumference of a cavity of the support, the coaxial plug having a pin to be connected to the second blade of the connector placed inside this cavity, and an external envelope to be connected to the earth blade.

10. Manufacturing procedure of a unit according to claim 1,

The support is moulded

The support is selectively metallised to make the first blade

The second blade is cut out and modelled to be pushed into a cavity of the support, from the lower side The support is mounted on a printed circuit board.

11. Unit according to claim 1 characterised in that the second blade has at least one flexible portion located in a cavity of the support and the at least one flexible portion is configured to be pushed away from an axis of insertion of a coaxial plug, upon insertion of the coaxial plug, in a direction of an internal perimeter of a wall of the cavity.

12. Unit according to claim 1 characterised in that the first blade includes an extension located on an upper side of the support and an arm that follows an outside perimeter of the support and curves back inside a cavity of the support.

* * * * *